US005222633A

United States Patent [19]

Blake

[11] Patent Number: 5,222,633

[45] Date of Patent: Jun. 29, 1993

[54] FOAM DISPENSING DEVICE

[75] Inventor: Joseph W. Blake, New Canaan, Conn.

[73] Assignee: Jack W. Kaufman, Merrick, N.Y.

[21] Appl. No.: 763,366

[22] Filed: Sep. 20, 1991

[51] Int. Cl.[5] ..... B67D 5/00

[52] U.S. Cl. ..... 222/179; 222/190; 222/400.8

[58] Field of Search ..... 222/179, 190, 400.7, 222/400.8, 564; 239/343, 330

[56] References Cited

U.S. PATENT DOCUMENTS

| | | | |
|---|---|---|---|
| 1,888,768 | 11/1932 | Lach | 222/190 |
| 1,919,257 | 7/1933 | Renzenhausen | 222/179 X |
| 2,119,906 | 6/1938 | Dorman | 222/190 X |
| 2,153,156 | 4/1939 | Pollnow | 222/179 X |
| 2,628,744 | 2/1953 | Mowbray | 222/179 |
| 3,141,578 | 7/1964 | Quinn | 222/181 X |
| 3,709,437 | 1/1973 | Wright | 222/190 X |
| 3,970,219 | 7/1976 | Spitzer et al. | 222/190 X |
| 3,973,701 | 8/1976 | Gardner | 222/190 |
| 3,981,597 | 9/1976 | Cohn | 222/190 X |
| 4,489,857 | 12/1984 | Batlas | 222/179 |
| 4,651,902 | 3/1987 | Hobbs et al. | 222/179 X |
| 4,844,344 | 7/1989 | Manhardt et al. | 222/564 X |
| 4,901,925 | 2/1990 | Blake, III | 222/190 X |
| 4,991,779 | 2/1991 | Blake, III | 222/190 X |
| 5,085,371 | 2/1991 | Paige | 239/343 |

FOREIGN PATENT DOCUMENTS

| | | | |
|---|---|---|---|
| 1289681 | 9/1972 | United Kingdom | 222/179 |
| 2106991 | 4/1973 | United Kingdom | 222/400.8 |

*Primary Examiner*—Gregory L. Huson
*Assistant Examiner*—A. Pomrening
*Attorney, Agent, or Firm*—Lackenbach Siegel Marzullo & Aronson

[57] ABSTRACT

Foaming device for mixing gas and foamable liquid in a container having a tube and cap configuration which enables the dispensing of foam from the container without need for squeezing or deforming the container.

13 Claims, 4 Drawing Sheets

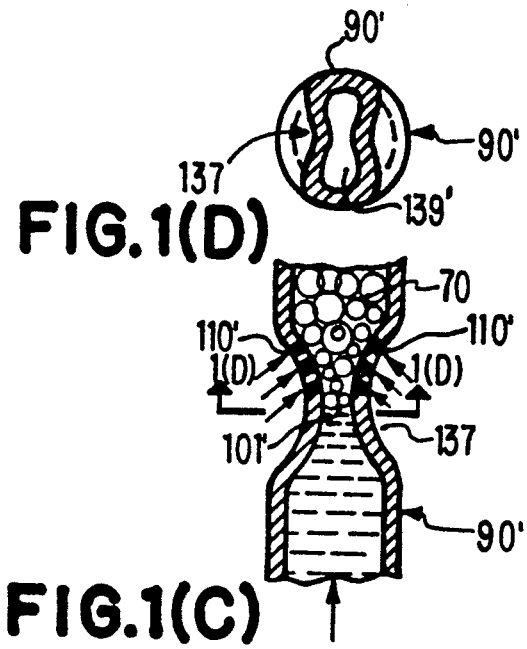
FIG.1(D)
FIG.1(C)
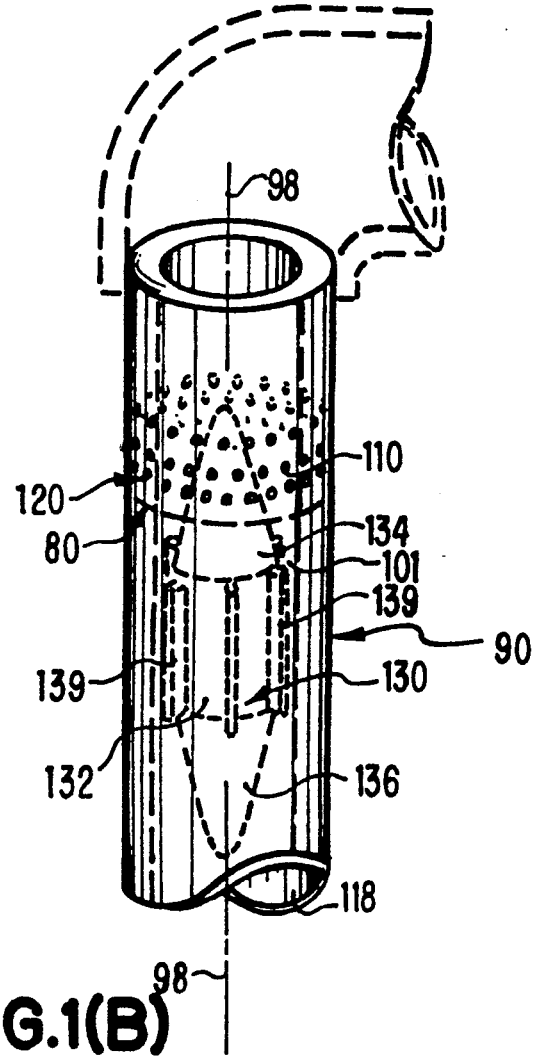
FIG.1(B)
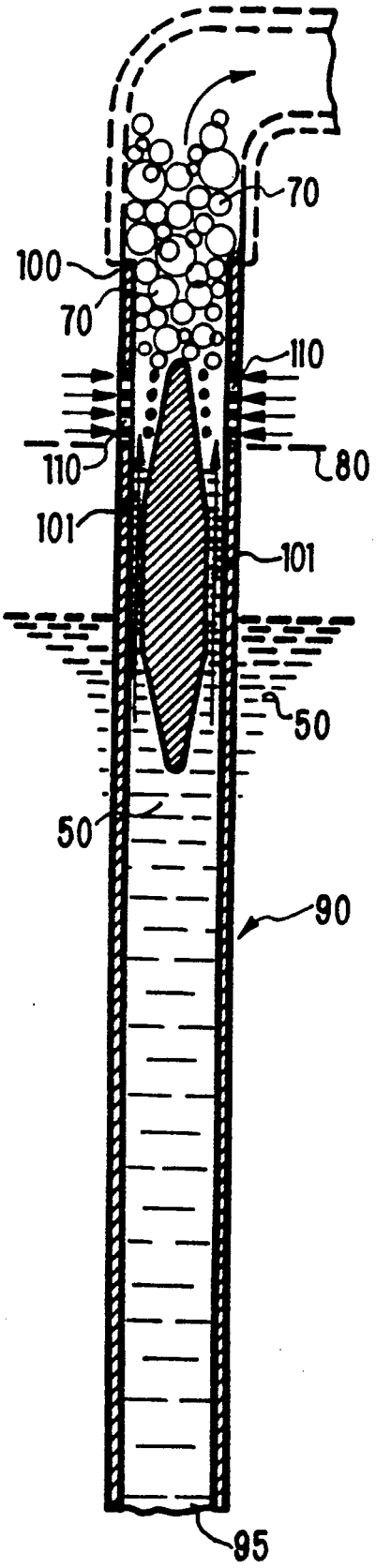
FIG.1(A)

FOAM DISPENSING DEVICE

BACKGROUND OF THE INVENTION

This invention relates to devices for producing and dispensing foams made by mixing foamable liquids and pressurized gases. More particularly, this invention is directed to a device for dispensing foams which can be operated without requiring the squeezing or deformation of foam containing vessels and which can be disposable in whole or part.

Handheld squeeze bottles of relatively small capacity for generating foams by non-aerosol techniques are widely known, for example, as described in U.S. Pat. Nos. 3,709,437, 3,937,364 and 4,531,660. Squeeze bottles, while effective for many purposes are necessarily of limited capacity and do not permit the hands of the user to be uninvolved in the use of the device.

SUMMARY OF THE INVENTION

It is an object of the present invention to provide a foaming device which can be used without manual operation.

It is another object of this invention to provide a foaming device which can be readily disposable in whole or in part.

It is a further object of the invention to provide a foaming device which is especially useful for "wash-ups" by medical personnel.

An other object of this device is to create a foaming means that does not pass foaming fluids through a porous element as many solutions such as PVP, and CHG, are prone to congeal and clog said element.

Another object is to provide a foaming device that is simple and inexpensive enough to allow for cost-effective disposability.

In accordance with the present invention a foaming device is provided for mixing foamable liquid, such as a foamable liquid soap, with a pressurized gas and to dispense the mixture as a foam. The present invention is particularly effective with difficult to foam liquids such as povidone iodine and chlorhexidine gluconate which are difficult to foam since the foaming agents normally added to conventional soap solutions are excluded. The device of the present invention is useful with a wide variety of solutions and is especially suited for the foaming of PVP and CHG. The device of the invention comprises a container for containing the foamable liquid having a tube means therein extending from a bottom tube opening adjacent the bottom portion of the container and exiting the container at an upper portion above the liquid. The tube has a peripheral portion above the pre-determined liquid level which has a plurality of small openings extending around the periphery of the tube. Liquid flow directing means are incorporated in the tube means adjacent the peripherally extending small openings and gas inlet means is provided which communicates with the container for introducing pressurized gas into the container at a location above the foamable liquid therein. Means are provided for sealing the container so that pressurized gas introduced into the container through the gas inlet means will force foamable liquid in the container into the tube means and past the flow directing means to mix with pressurized gas passing from the container into the tube means through the plurality of small peripheral openings in the tube means and thereby form foam which is forced out of and exits the tube means.

BRIEF DESCRIPTION OF THE DRAWINGS

FIG. 1 (A) is an elevation view in section of the tube means of the device of FIG. 1;

FIG. 1(B) is an enlarged, partial perpsective view, of the tube and showing the flow direction means of FIG. 1(A) in greater detail;

FIGS. 1 (C) and 1 (D) are respectively, a partial sectional view and a cross-sectional view (along the line 1(D)—1(D)) of an alternate embodiment of the tube of FIG. 1(A);

DETAILED DESCRIPTION OF THE PREFERRED EMBODIMENTS

Figure 1:
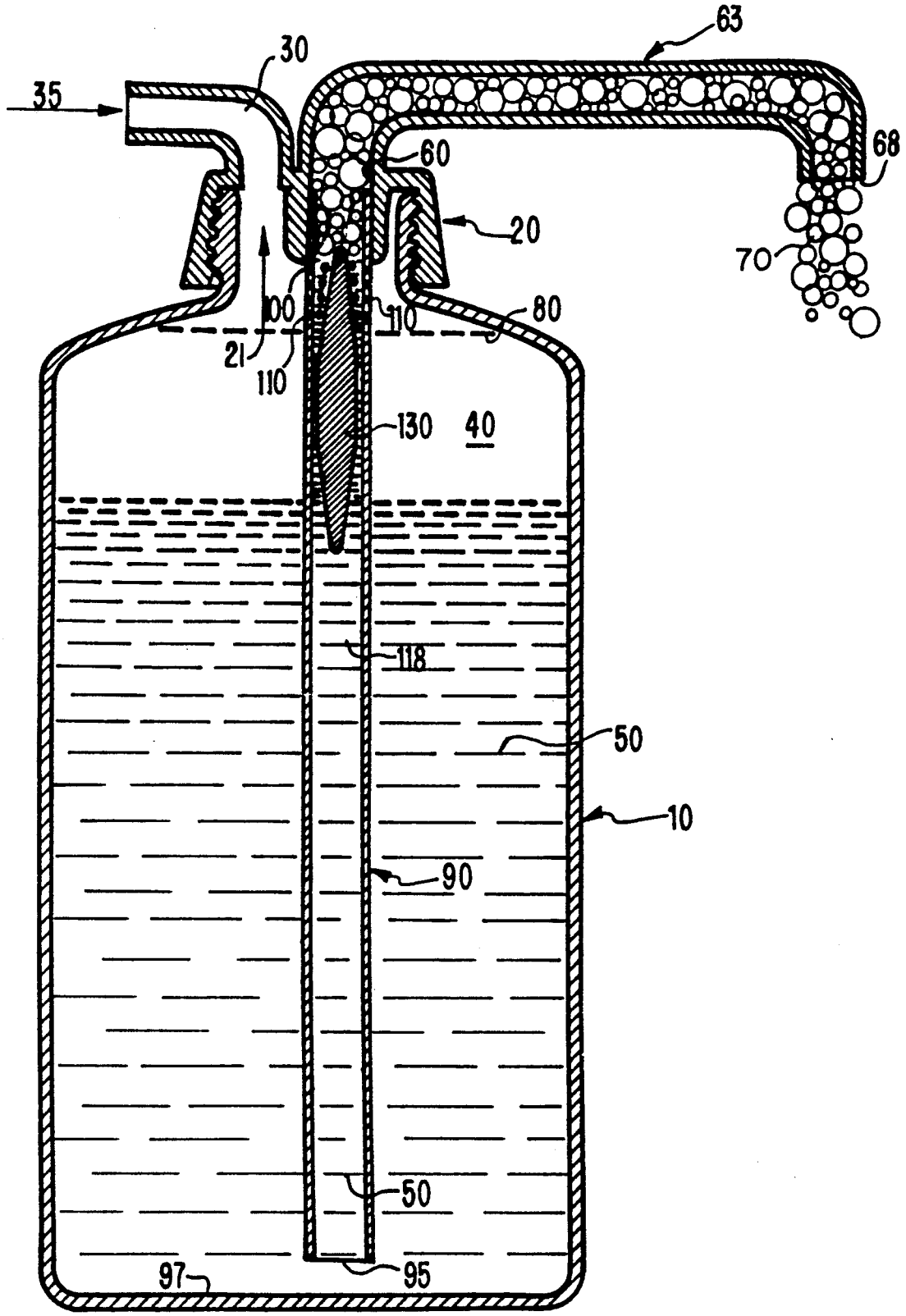
FIG. 1 is an elevation view in section of a foam dispensing device of the invention.

With reference to FIGS. 1 and 1(A)-(D) a bottle 10, suitably of a rigid plastic construction and suitable for containing stored liquid, has a cap member 20 threadably engaged at its upper opening 21. Cap member 20 has an inlet conduit 30 passing therethrough for the passage of pressurized gas in the direction indicated at 35 into the interior of container 10 at 40 above a foamable liquid 50 in the container 10. Cap member 20 has an outlet conduit 60 passing therethrough for the exit of foam 70 from container 10 as hereinafter described. Foamable liquid 50 can be stored in pre-filled container 10, a pre-filled self-contained unit in which the cap locks permanently on the bottle and the entire assembly including the foamer is disposable. Alternately, a conventional container cap can be employed and removed when ready for use and the container 10 may be threadably connected to the foaming device cap 20 hereinabove described. The foamable liquid is at the level indicated at 80. When foam is required, e.g. for "wash-up" by medical personnel engaged in a procedure or examination, compressed gas, e.g. compressed air, is introduced in the direction indicated at 35 through inlet 30 into container 10 at 40 above foamable liquid 50. The pressure of the gas in zone 40 is at a level which causes the pressure exerted on the surface of foamable liquid 50 in zone 40 to force foamable liquid 50 upward in hollow tube 90 which has an inlet opening 95 for receiving pressurized foamable liquid in the lower portion of container 10 adjacent the bottom end 97 thereof.

Tube 90 communicates with the outlet conduit 60 of cap member 20 at its outlet end 100 opposite to its inlet 95. Closely adjacent to the outlet end 100, and "downstream" therefrom a plurality of small diameter individual through-passages or openings 110 are provided in a peripheral array, or band, 120 surrounding tube 90. Adjacent to the peripheral passages 110, a liquid flow directing element 130 is provided at interior tube 90. The flow directing element has a cylindrical body 132 with "streamlined" generally forward conical (upstream) and rear (downstream) portions 134, 136 which are axially in-line with the longitudinal axis 98 of tube 90. The cross-section of cylindrical body portion 132 is slightly less than that of the interior of tube 90, and is tightly held and is supported therein by integral radial vanes 139, leaving an annular passage 101 therein which widens and extends opposite to and past the peripheral array of openings 110. If the tube 90 does not have flow directing means, the fluid flowing therein will foam only where it is nearest the tube wall in the location of the peripherally positioned small air inlet openings 110. The center of the flowing column of fluid will not receive sufficient air to create foam hence incomplete foaming resulting in a wet drippy partially foamed output. The purpose of the flow directing means is to guide a thinner layer of fluid close to the tube wall allowing it to be thoroughly homogenized by the impinging air. Thus, the device creates foam by the spreading of the liquid into a generally thin stream close to the tube wall where it is virtually simultaneously impinged upon at a substantially right angle by the rushing air stream passing through the tube openings.

Pressurized gas mixes with foamable liquid 50 inside tube 90 and foam 70 is formed in tube 90 and carried by the flow of pressurized gas through peripheral passages 110 through outlet conduit 60 and out of communicating spigot 63 as indicated at 68. As best shown in FIG. 1(C) and 1(D), in place of the interior flow directing element 130 of FIGS. 1, 1(A) and 1(B), tube 90' can be provided with a short flattened segment 137 which directs gas flow at the narrowest passage 139 in tube 90'(generally parallel due to "flattened" tube) which expands at 101' inwardly adjacent to peripheral passages 110' and pressurized gas is drawn into tube 90' on the same principle as with flow directing element 130 and foam 70 is formed and carried through outlet conduit 60 of cap member 20 and exits spigot 68. The flattened segment may be permanently formed in the tube 90' or the tube may be held in a flattened condition, by means of a clothespin-like element (not shown), suitably pressed onto and across tube 90'.

Figure 2:
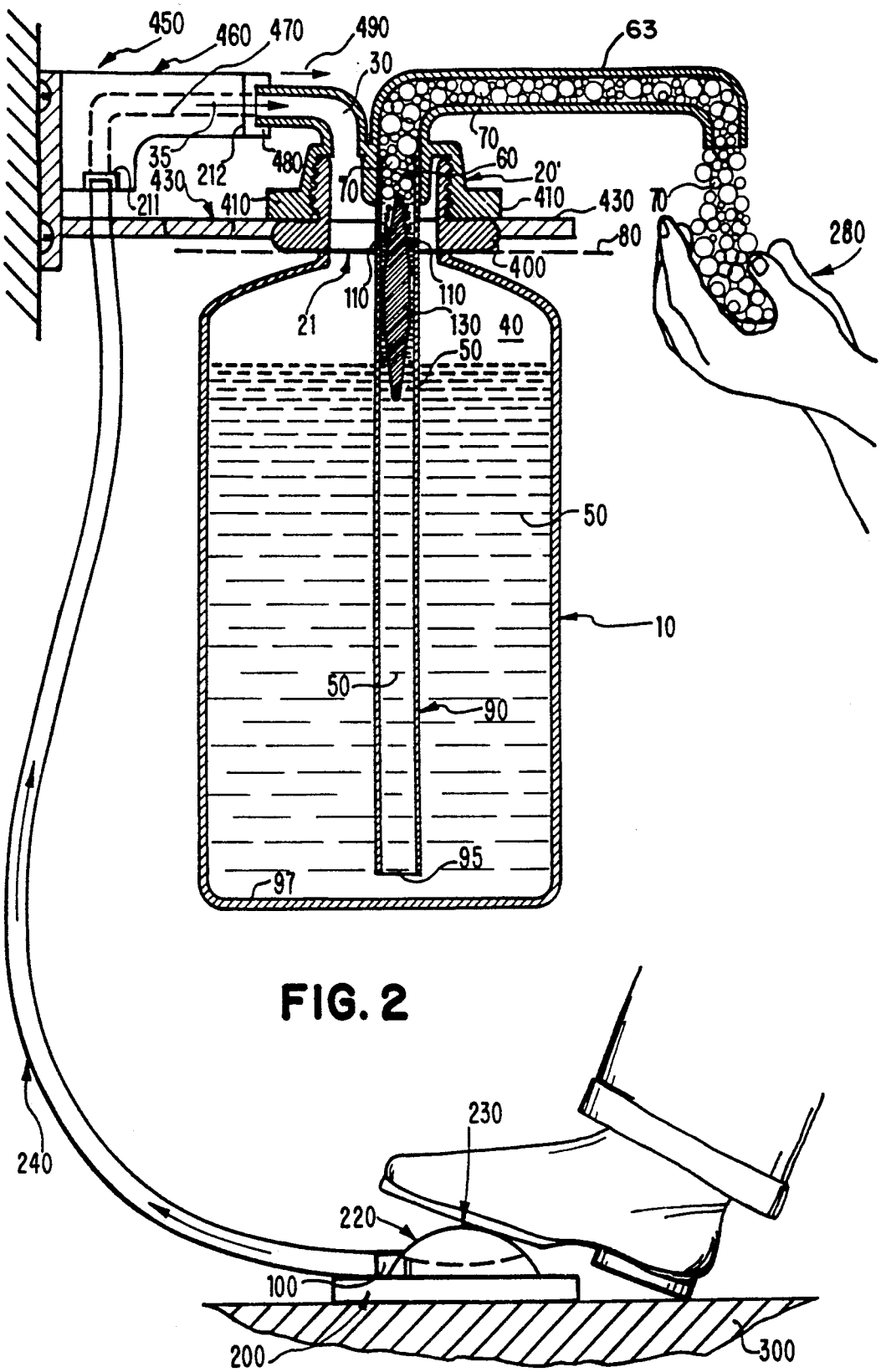
FIG. 2 shows an elevation view in section of wall mounted device in accordance with the present invention utilizing a pedal operated gas pressurizing device.
Figure 3:
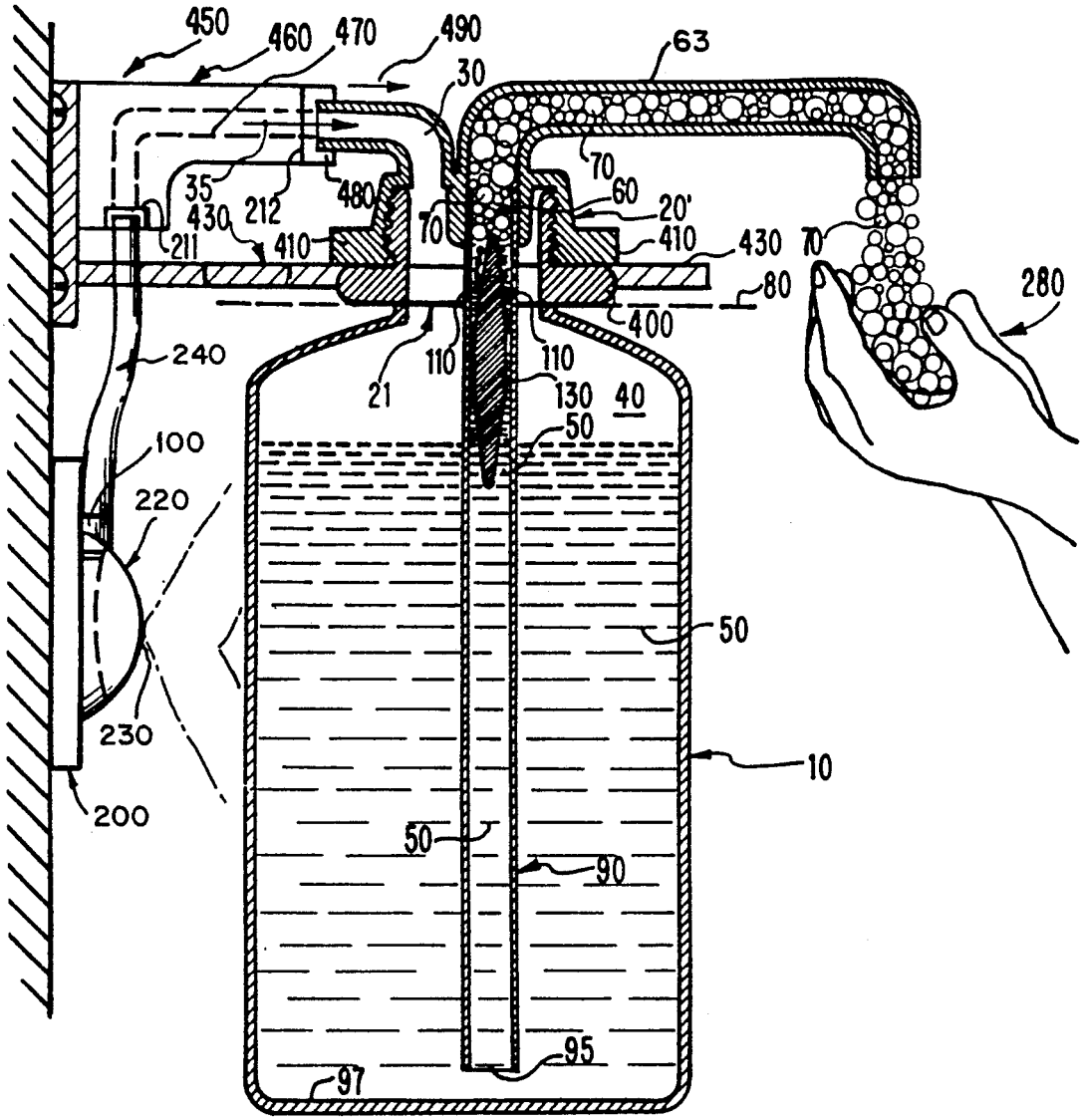
FIG. 3 is similar to FIG. 2, but instead depicts an elbow operated pressurizing device.

FIG. 2 shows a particular embodiment of the present invention particularly suited for medical facilities and the like where personnel frequently need to "wash up" or "scrub up" using a soap and/or disinfectant, such as povidone-iodine scrub or a chlorhexidine gluconate solution. In this case, the foamable liquid 50 is a scrub solution and pressurized gas is provided by foot (or hand/arm, as shown in FIG. 3) actuating of a pedal type air pump 200 which can be operated as shown in FIG. 2 so that the personnel using the device can keep both hands free. Pedal pump 200 and resilient diaphragm 220 is actuated as indicated at 230 and the gas (air) pressure passing through flexible line 240 and inlet conduit 30 into zone 40 above foamable liquid 50 causes the foamable liquid 50 to rise in tube 90. A one-way check valve 211 and a filter 212 are mounted on wall bracket 450 between pump 200 and container 10. The pump 200 may be suitably positioned and/or secured to a floor or wall, as shown at 300.

In order to perform the function of foaming and dispensing, a fresh supply of air must be drawn in from outside the unit. That air is utilized for displacing the fluid in the container as well as mixing with the solution to create foam. The air is drawn in through one-way valve 211 assembled in the wall bracket 450. Since the same air is drawn in from a particulate contaminated environment, it is desirable to filter incoming air prior to mixing with the scrub solution. Suitably, there is optionally provided a filter 212 on the intake side of the one-way valve 211. The valve and filter assembly is mounted in the wall bracket that receives the disposable bottle/foamer combination. The reason for selecting this location is that it is simpler than trying to combine it with the foot pedal and that it is less vulnerable to any floor-borne contaminants which could be drawn in at floor level and subsequently sent to the foamer. When the foamable soap solution 50 passes adjacent peripheral passages 110, foam is formed, as previously described, for use in hand washing as indicated at 280. The present invention injects air into a passing stream of fluid and does not require that both fluid and air be passed through the element to homogenize the mixture into foam.

The flow of foam 70 is readily adjusted by foot (or hand/arm) operation of pedal pump 200. Container 10 is suitably provided with a neck ridge to support the foaming unit in the wall mounted bracket. The container 10 may be filled to one quart (946 ml) or to one liter (1000 ml). Liquid 50 is just below the lower peripheral passages 110. If the peripheral passages 110 are below the level of foamable liquid 50 the device will not produce foam. In FIG. 2, the removable cap 20' is provided with a protruding peripheral rim extension 410 which permits the cap 20' and attached container 10 to be supported on arms 430, 432 (not shown) of wall mounted bracket 450 which includes a manifold 460 with a through passage 470 for the passage of pressurized gas from pump 200 to inlet conduit 30 which is detachably connected at 480 to manifold 460. When the contents of container 10 have been used up, the cap 20 is moved (with container 10) in the direction 490 to disengage the cap from the manifold 460. The empty container 10 and the entire unit can be disposed and replaced as hereinabove described; or separated from cap 20' and replaced by a filled container; or alternatively the container 10 can be refilled. Inlet conduit 30 is then reconnected at 480 and operation of the foaming device can continue. Also, the working elements of the basic foaming concept can become part of a cap assembly of the device, i.e. the peripheral air openings and the flow director. This modified assembly would allow a plain dip tube to be inserted into the cap. In place of pedal pump 200 a suitable bellows or other air displacing means may be mounted on, or become part of the foamer cap 20. Such a configuration would utilize the same foaming means and allow for a totally self-contained manually operated stand-alone unit for use in less contamination sensitive areas, such as a nurses' stations.

While only certain preferred embodiments of this invention have been described, it is understood that many embodiments thereof are possible without departing from the principles of this invention as defined in the claims which follow.

What is claimed is:

1. A foaming device for mixing foamable liquid with a gas to form a mixture thereof and to dispense the mixture as a foam, said foaming device comprising:

a) a container having a lower and an upper portion and a container foam outlet means and adapted for containing a foamable liquid;

b) tube means, having a passageway, arranged within said container extending from an opening in the tube means positioned adjacent the lower portion of the container to an upper opening which communicates with said container foam outlet means, said tube means having a peripheral portion above a predetermined liquid level and said tube means having a plurality of peripherally extending small openings at its peripheral portion positioned above the pre-determined liquid level;

c) liquid flow reducing means for narrowing the passageway in said tube means adjacent said peripherally extending small openings for forming an annular passage;

d) a gas inlet means communicating with said container for introducing pressurized gas into said container at a location above the foamable liquid; and e) means for sealing said container so that pressurized gas introduced into the container from the gas inlet means will force foamable liquid in the container into the tube means and past the liquid flow reducing means to mix with the pressurized gas passing from the container transversely into the tube means through the plurality of small openings in the tube means, and thereby form foam which is forced out of and exits the tube means through said foam outlet means.

2. The device in accordance with claim 1, wherein said means for sealing said container includes a detachable cap member and said gas inlet means and said foam outlet means are formed as conduits in said cap member.

3. The device in accordance with claim 1, wherein said flow reducing means is in the form of a cylindrically cross-sectioned body having at least one generally conical end portion located within the tube means and axially aligned therein and spaced from the inner surface of the tube means.

4. The device in accordance with claim 1, wherein said flow reducing means is in the form of a narrow flattened portion of the tube means.

5. A foaming device for mixing foamable liquid with a gas to form a mixture thereof and to dispense the mixture as a foam, said foaming device comprising:

a) a container adapted for containing foamable liquid having an open top;

b) cap means removably engageable with the container, said cap means having an inlet conduit extending therethrough for transmitting pressurized gas into said container and an outlet conduit extending therethrough for transmitting foam out of said container;

c) dip tube means, having a passageway, communicating with and extending away from said outlet conduit and into the container, having an opening remote from said cap means for receiving the foamable liquid and having a plurality of small peripheral openings adjacent an upper opening communicating with said outlet conduit for the passage of the pressurized gas from the container transversely into the dip tube means;

d) liquid flow reducing means in the vicinity of the small peripheral openings for narrowing the passageway in said dip tube means;

e) actuatable gas pressurizing means having an outlet for transmitting pressurized gas upon actuation thereof; and f) tubular conduit means in communication between the outlet of the actuatable gas pressurizing means and the inlet conduit of the cap means.

6. The device in accordance with claim 5, wherein said flow reducing means is in the form of a cylindrically cross-sectioned body having at least one generally conical end portion which is located within the dip tube means and axially aligned therein and spaced from the inner surface of the dip tube means.

7. The device in accordance with claim 5, wherein said flow reducing means is in the form of a narrow flattened portion of the dip tube means.

8. The device in accordance with claim 5, wherein said cap means is removably mounted on a wall or structural member.

9. The device in accordance with claim 5, wherein said actuatable gas pressurizing means is surface mounted and is limb operated.

10. The device in accordance with claim 5, wherein said actuatable gas pressurizing means is wall mounted and is elbow operated.

11. The device in accordance with claim 9, wherein said pressurized gas is air.

12. The device in accordance with claim 10, wherein said pressurized gas is air.

13. The device in accordance with claim 5, wherein said actuable gas pressurizing means is surface mounted adjacent said foaming device for easy access and actuation when said foaming device is in use.

* * * * *